US005984759A

United States Patent [19]

O'Sullivan

[11] Patent Number: 5,984,759

[45] Date of Patent: Nov. 16, 1999

[54] YO-YOS AND AN IMPROVED AUTOMATICALLY RETURNING YO-YO

[76] Inventor: Brendon M. O'Sullivan, 18 Belson St., East Malvern, Australia, 3145

[21] Appl. No.: 08/950,947

[22] Filed: Oct. 15, 1997

[30] Foreign Application Priority Data

| | | | |
|---|---|---|---|
| Jul. 14, 1997 | [AU] | Australia | PO7872 |
| Aug. 19, 1997 | [AU] | Australia | 34257/97 |
| Sep. 5, 1997 | [AU] | Australia | 36832/97 |

[51] Int. Cl.[6] ..... A63H 1/30

[52] U.S. Cl. ..... 446/250; 446/251; 446/255

[58] Field of Search ..... 466/250, 251, 466/255

[56] References Cited

U.S. PATENT DOCUMENTS

| | | | |
|---|---|---|---|
| 3,175,326 | 3/1965 | Isaacson | 446/250 |
| 3,256,635 | 6/1966 | Radovan . | |
| 4,130,962 | 12/1978 | Ennis | 446/250 |
| 4,207,701 | 6/1980 | Kuhn . | |
| 4,332,102 | 6/1982 | Caffrey | 446/250 |
| 4,895,547 | 1/1990 | Amaral | 446/250 |

*Primary Examiner*—Robert A. Hafer
*Assistant Examiner*—Bena B. Miller
*Attorney, Agent, or Firm*—Alix, Yale & Ristas, LLP

[57] ABSTRACT

Improvements in automatically returning yo-yos in which an effective centripetal/centrifugal movement, vector, signal and/or urge of one or more parts of the yo-yo is translated or allowed to be translated into an effectively reciprocating movement, vector, signal and/or urge, substantially along or parallel to the axis of rotation of the yo-yo, of another part or parts of the yo-yo such that the yo-yo string and/or the lateral face(s) of the string bearing member are seized, tripped, freed, laterally supported and/or centered in response to the speed of rotation of the yo-yo. The yo-yo of the present invention displays characteristics of extended spinning time, improved balance and adaptability for performing tricks while providing an easy to operate yo-yo for beginners including an automatic return facility.

49 Claims, 2 Drawing Sheets

YO-YOS AND AN IMPROVED AUTOMATICALLY RETURNING YO-YO

FIELD

This invention relates to improvements in yo-yos and an improved automatically returning yo-yo.

BACKGROUND

Yo-yo players, especially beginners, have been assisted by the development of yo-yos provided with a means to automatically return the yo-yo to the player's hand before the yo-yo spins out completely. Such an arrangement is described, for example, in U.S. Pat. No. 4,332,102 to Caffrey.

The Caffrey patent discloses a yo-yo having a rotatable bearing pulley mounted on the axle to which the yo-yo string is attached. Adjacent the pulley section of the bearing there is provided a cylindrical friction or braking means that interacts with two clutch mechanisms. The surface of the friction or braking means has a slip resistant characteristic and is in practice one or a series of O-rings, which are subject to wear. The clutch mechanism is provided with weighting means such that when the yo-yo is thrown the clutch is released by the development of centrifugal forces. The centrifugal forces are counterbalanced by a spring-loaded force such that the clutch is activated when the yo-yo slows down. The clutch engages the cylindrical friction surface of the pulley extension while the yo-yo still has sufficient momentum to enable the automatic return of the yo-yo to the player's hand. The successful development of an automatically returning yo-yo has proven to be especially valuable to beginners. It is also viewed as a valuable assistance to less gifted or handicapped players.

The nature of the arrangement shown in Caffrey, however, is such that it tends to critically weaken the structural integrity of the yo-yo. The pulley bearing to gain access to the clutch mechanism housed within a yo-yo half requires part of the boss enclosing the axle to be removed in the plastic mold. To enable sufficient braking capacity to be applied, up to 80% of the plastic boss must be removed where the pulley extension friction surface meets the clutch mechanisms.

Also, because the pulley is also the string bearing means, problems occur when bearing lubrication applied in excess finds its way with the aid of centrifugal forces to the nearby contact area between clutch and pulley such that the clutch slips and fails to return the yo-yo successfully.

The arrangement disclosed in Caffrey, by linking the centrifugally operated clutch to a coaxial extension of the string bearing means, has intrinsically restricted options on varying the quality of the string bearing means. The use of a dual purpose bearing that combines a string securing means as well as a clutch interfacing means where the clutch means is operatively enclosed in the yo-yo half must by nature expand laterally along the axial member to accommodate both functions. Caffrey achieves a superior spinning automatically returning yo-yo is achieved by narrowing the string bearing means thereby reducing the area frictionally contacting the axial member. Having the centrifugally activated clutch operatively engage an integral extension of the string bearing means also necessitates the use of double-loop string attachment to inhibit the string from slipping on the bearing means and thereby reducing the clutch effectiveness. The general public have difficulty in tying a double-loop attachment.

Also, the Caffrey arrangement, at least in its commercial embodiments in which the clutch mechanism occupies only one yo-yo half, exhibits a weight differential between the two yo-yo halves that is believed to shorten free spinning time.

Another problem experienced with a conventional automatically returning yo-yo which has a static spacing between yo-yo halves is that different yo-yo manoeuvres, to be performed efficiently, require different yo-yo response tolerances. Tom Kuhn in his publication "SB2Flight Manual" in "The Art of Yo-Yo Choreography", indicates a narrower string gap is better for loop-the-loops and a wider string gap is better for complex spin tricks.

SUMMARY

The present invention in one aspect resides in providing an automatically returning yo-yo that is free of the limitations of prior art designs. In another aspect, the present invention comprises improved means of automatically returning the yo-yo. It is also a goal of the invention to improve the structural integrity and ease of maintenance in an automatically returning yo-yo. The present invention also permits a superior free spinning time and improved loop-the-loop characteristics without sacrificing superior performance in free-spinning time. A yo-yo according to the invention also accommodates the natural progression of an operator's skills by allowing the removal of the automatic returning mechanism and conversion of the yo-yo to a conventional yo-yo with multi optional performance spinning characteristics by allowing the selective use of string bearing means of various compositions and properties. In addition a yo-yo according to the present invention optionally allows an automatically returning yo-yo requiring only single-loop string attachment.

These features are achieved in the present invention through provision of a yo-yo wherein an effective centripetal/centrifugal movement, vector, signal and/or urge, i.e., a force, of one or more parts of the yo-yo is translated or allowed to be translated into an effectively reciprocating movement, vector, signal and/or urge of another part or parts of the yo-yo substantially along or parallel to the axis of rotation of the yo-yo such that the string of the yo-yo is seized, tripped, freed, laterally supported centered or otherwise engaged in response to the speed of rotation, i.e., rotational velocity of the yo-yo. Alternatively, an effective centripetal/centrifugal movement, vector, signal and/or urge of one or more parts of the yo-yo is translated or allowed to be translated into an effectively reciprocating movement, vector, signal and/or urge of another part or parts of the yo-yo substantially along or parallel to the axis of rotation of the yo-yo such that the lateral face(s) of the either an axle assembly or string bearing member are seized, tripped freed, laterally supported and/or centered in response to the speed of rotation of the yo-yo, or the effectively reciprocating movement, vector, signal and/or urge acts, directly or indirectly, on the yo-yo string only, on the lateral face(s) of the string bearing member only. As another alternative, an effective centripetal/centrifugal movement, vector, signal and/or urge of one or more parts of the yo-yo is translated or allowed to be translated into an effectively reciprocating movement, vector, signal and/or urge of another part or parts of the yo-yo or on the lateral face(s) of the string bearing member in conjunction with the yo-yo string substantially along or parallel to the axis of rotation of the yo-yo so as to free, center, laterally support, seize and/or trip the said string and/or string bearing member in response to the speed of rotation of the yo-yo.

The yo-yo of the present invention comprises two yo-yo halves, a connected or connecting axial member or an axle assembly about which the yo-yo spins, a string bearing member and an effectively centrifugally/centripetally activated dynamic means, or clutch and optionally further seizing, tripping, freeing, laterally supporting and/or centering means acting, in an effectively reciprocating manner substantially along or parallel to the axis of rotation of the yo-yo. The clutch means act upon the yo-yo string and/or the lateral face(s) of the string bearing member. The dynamic means includes translation means whereby an effective centrifugal/centripetal movement, vector, signal and/or urge is translated into an effective reciprocating movement, vector, signal and/or urge acting, directly or indirectly, on the yo-yo string and/or the lateral face(s) of said string bearing member. The translation means may include pivots, levers, elbows, cams or cam surfaces, including inclined planes, springs, elastic, electric or electronic, pneumatic, hydraulic and/or other means convenient to the realization of the present invention.

Throughout the present specification, the term effective centripetal force is understood to be a force that comes into play in the absence of a superior centrifugal force or which overcomes a centrifugal force, and may be provided by means acting not in a strictly centripetal direction. Similarly, a centrifugal force or movement may be understood as referring to that vector or component of a complex force or movement acting or allowing action in a centrifugal direction.

By acting on the yo-yo string and/or the lateral face(s) of the string bearing member, the seizing/centering means or engagement-member of the present invention allows for a reduction in the surface area of the string bearing member in contact with the axial member and consequent reduction of friction resulting in potentially longer spinning times. It also allows for interchangeability of string bearing members of various compositions and properties to suit the operator.

Further, when acting along the axis of rotation of the yo-yo, symmetrically and opposedly about the mid-point between the medial faces of the two yo-yo halves, optionally at a radial distance out from the circumference of contact between string and string bearing member, the seizing means of the present invention provides a superior centering and lateral support/control means for the yo-yo string between the two yo-yo halves which has been found to provide improved resistance to precession. This, in combination with the seizing of the string and/or string bearing member at the apogee of the loop-the-loop throw, is thought also to contribute to the superior loop-the-loop capacity of the automatically returning yo-yo of the present invention. Thus the yo-yo of the present invention uniquely combines the positive characteristics of two different modes of yo-yo performance, usually requiring different yo-yo settings: loop-the loop and long spin capacity necessary for string tricks.

Those embodiments wherein the string rather than the string bearing member is seized allow a single-loop string attachment in an automatically returning yo-yo. This can also be achieved by incorporating a suitable flange on the annular seizing/centering means of those embodiments in which the vertical faces of the string bearing member are seized such that there is interference with the string.

In those embodiments where the yo-yo is, in response to its speed of rotation, automatically prevented from spinning freely with respect to the string bearing member by the compressive seizing of the lateral face(s) of the string bearing member only, a secure attachment of the string to the string bearing member is required so that the yo-yo is forced to climb the string to the operator's hand, and a double loop string attachment is recommended.

The seizing means of the present invention, when acting on the lateral face(s) of the string bearing member, allow the effective operation of the present invention in an embodiment incorporating the invention in only one yo-yo half.

It should be understood that the automatically returning yo-yo of the present invention may also be returned to the operator's hand at any time prior to engagement of the automatically activated means by the operator flicking or jerking the string.

It is within the scope of the present invention to include the seizing/tripping/centering/lateral support means in one or both yo-yo halves. It is also within the scope of the present invention to use the axial member as the string bearing means.

DETAILED DESCRIPTION OF PREFERRED EMBODIMENTS

Figure 4:
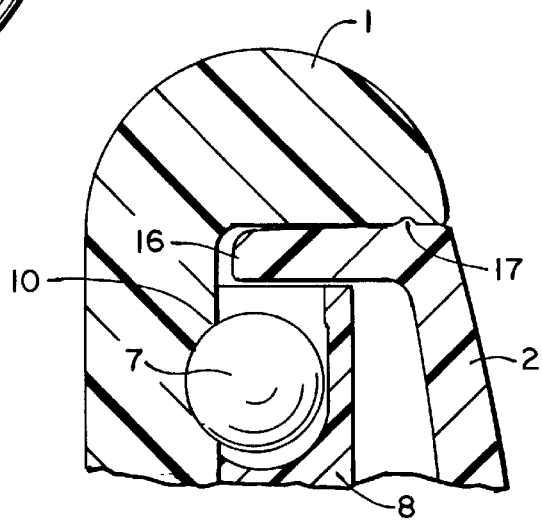
FIG. 4 is an enlarged radial sectional detail through the region of the circumference of a yo-yo half showing the cam surface translation means of a preferred embodiment.

With reference to the drawings, an embodiment of the yo-yo of the present application is shown which includes two yo-yo halves. The outer body of each half is further composed of a first casing part and a second casing part. The first casing part 1 comprises an inner or medial face provided with a recess 15 to accommodate a string bearing means 3 and optional adjacent seizing/freeing/lateral supporting and/or centering means 4 and bores 12 to accommodate the corresponding effectively centrifugally/centripetally activated push/pull rods 14; the outer rim, axial bore and boss. On the medial faces of component first casing part 1 surrounding the recess 15 there may be provided a plurality of radially arranged ribs 13, optionally raised, to assist the winding and unwinding of the yo-yo string. The second casing part is a cap 2 which provides the outer or lateral face of the yo-yo half. The cap 2 is optionally provided with means 17, best seen in FIG. 4, to snap lock the cap 2 into position. A medial rim 16 of a flange of cap 2 is optionally provided with a suitable profile to assist in the secure location of decorative means.

Figure 1:
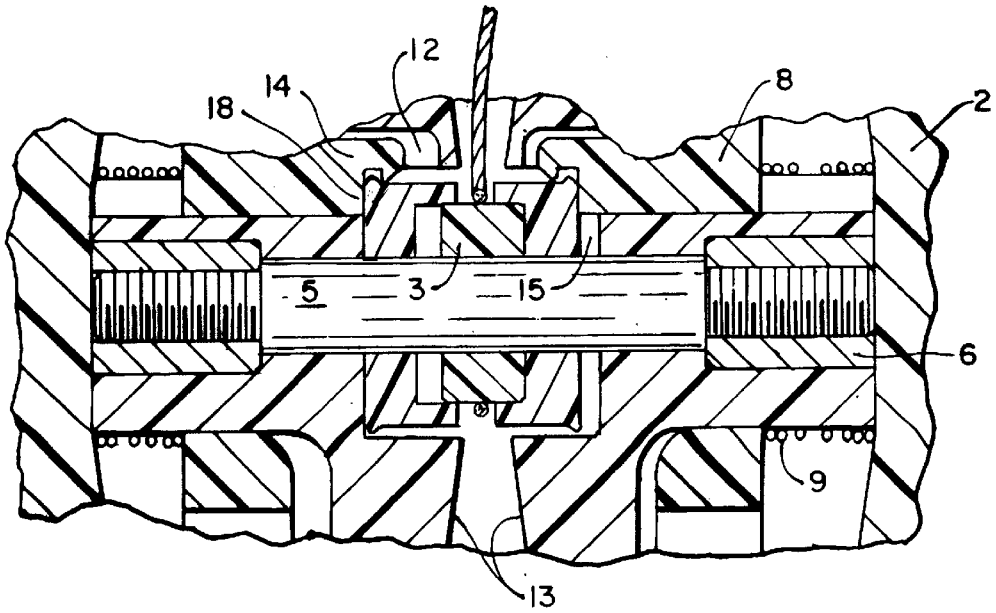
FIG. 1 is an enlarged sectional detail through the diameter of the yo-yo showing the axial member and the effectively reciprocatingly acting members.

The two yo-yo halves are joined by an, axle-assembly or other connecting member, such as a threaded axle 5 as in the embodiment shown in detail in FIG. 1. In this case, each yo-yo half is provided with a threaded nut 6 inserted and suitably secured into the axial boss via the lateral face of the first casing part 1. The yo-yo halves are then joined by inserting the threaded axle 5 through the axial bores via the yo-yo medial faces and screwing the axle 5 into the nuts 6.

Again with reference to FIG. 1, the seizing/freeing/laterally supporting and/or centering means 4 (hereinafter referred to as seizing/centering means or engagement-member 4) is shown moveably located on the axial member in the form of optionally flanged annuli, located coaxially adjacent either or both side(s) of a string bearing means 3 and able to transmit any movement, vector, signal or urge from the dynamic means or centrifugally-activated clutch to the string and/or the string bearing means. The seizing/centering means 4 are provided with means to accept the push/pull rods 14 of component 8 when in effective centripetal/centrifugal modes, respectively. The rods 14 are designed to operatively engage, lock, and guide the seizing/centering means thereby increasing the grip on the string and/or the string bearing means when in effective centripetal mode and clearing the string and/or string bearing means when in centrifugal mode. A detail of a suitable locking means 18 is shown in FIG. 1. The seizing, centering, and lateral support of the string by the seizing/centering means enables a superior balanced yo-yo that performs extremely well as a loop-the-loop yo-yo while maintaining superior performance as a free-spinning yo-yo and also allows the preferred modality of single loop string attachment.

Figure 5:
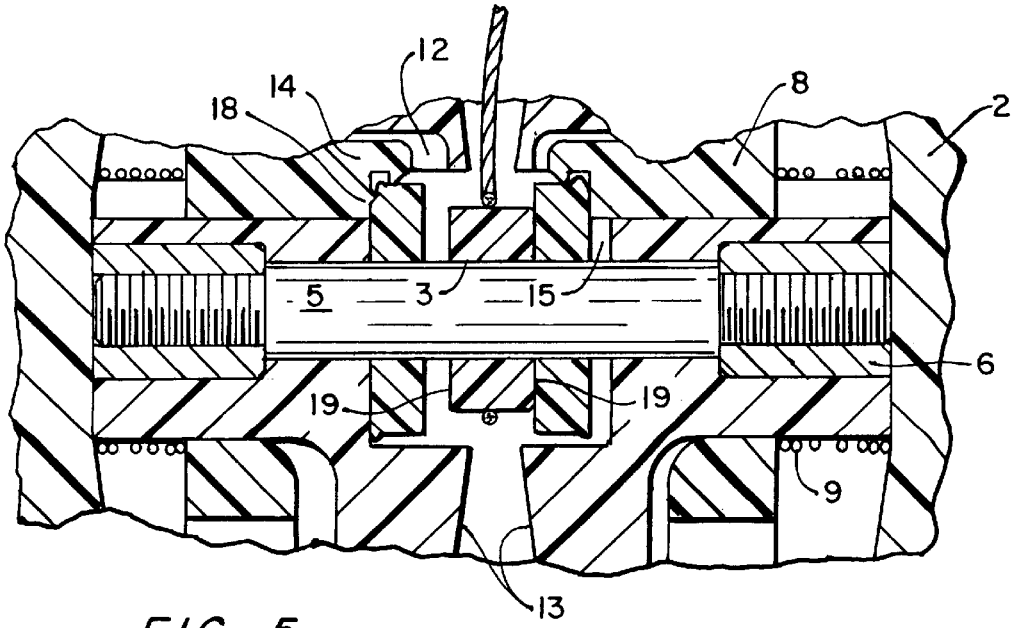
FIG. 5 is an enlarged sectional detail through the diameter of the yo-yo showing the axial member and the effectively reciprocatingly acting members in an embodiment in which the string bearing means is seized.

FIG. 5 shows a detail of an embodiment in which the seizing/centering means acts directly on the lateral face(s) (i.e., braking surface(s)) of the string bearing means only. Flange arrangements ranging from the absence of a flange as in the arrangement of FIG. 5 to the string only snaring flange of FIG. 1 are all comprehended in the present invention, as are various dimensions of the annulus and flange.

In another embodiment, not shown, the rods 14 may act directly on the string or another seizing means.

Optionally, the locking and guiding means may also be achieved or augmented by projections from the seizing/centering means engaging corresponding recesses in the medial face of the recess 15 or by projections from the medial face into recesses in the seizing/centering means.

The string bearing means 3 rotatably supported on the axial member optionally includes a ball or roller bearing, a molded, pressed or machined spool, a low friction plastic spool, a metal spool, a wooden spool, a dual or multi-layered spool, a grooved string-accommodating spool, and/or a spool with anti-string-slip qualities. It is a desirable feature of the yo-yo of the present invention that the string bearing means be interchangeable according to the performance characteristics desired by the operator.

Figure 2:
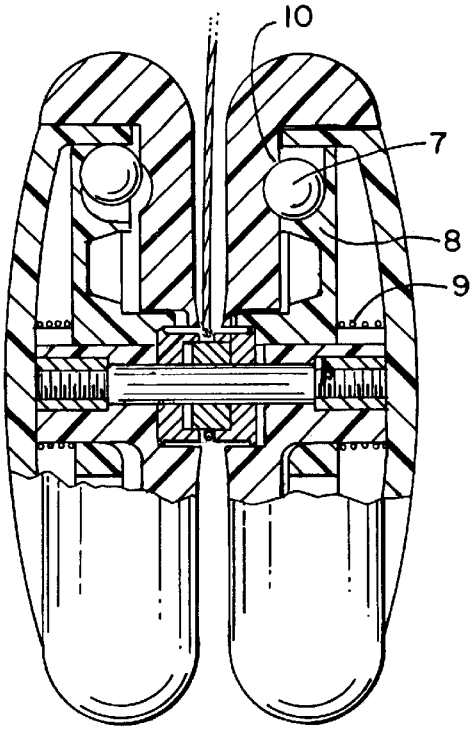
FIG. 2 is a sectional view taken through the diameter of the yo-yo, showing centrifugally (left) and centripetally (right) influenced states.

According to the present invention, inside one or both of the yo-yo halves is housed dynamic centrifugally/effectively centripetally activated means acting upon the seizing/centering means or the string. This is shown in FIG. 2 in the centrifugally influenced mode (left yo-yo half) and effective centripetally influenced mode (right yo-yo half) The dynamic activated means preferably includes four components or multiples of these components. In the embodiment shown, these components include a centrifugally activating mass 7, a centripetally/centrifugally engaged or allowed counter force means 9, a translation means 10, and a centrifugally and effectively centripetally activated displaceable means 8 acted upon by the mass 7 and the counter force and acting upon the seizing/centering means 4 in an effectively reciprocating motion parallel to the axis of rotation of the yo-yo. Access to influence the seizing/centering means is provided for the displaceable means 8 by one or more bores 12 through the outer face of the first casing part 1, said bores optionally traversing the first casing part 1 completely.

The mass 7, effectively centripetally activated displaceable means 8, or centripetally/centrifugally engaged or allowed counter force means 9, either alone or in combination, preferably utilize first casing part 1 and/or second casing part 2 as support structure, by way of position and/or shape and/or coefficient of friction and/or substantiality and/or kinetic potential, to facilitate the transfer to dominance of effective centripetal or centrifugal mode at a predetermined speed of rotation of the yo-yo.

Figure 3:
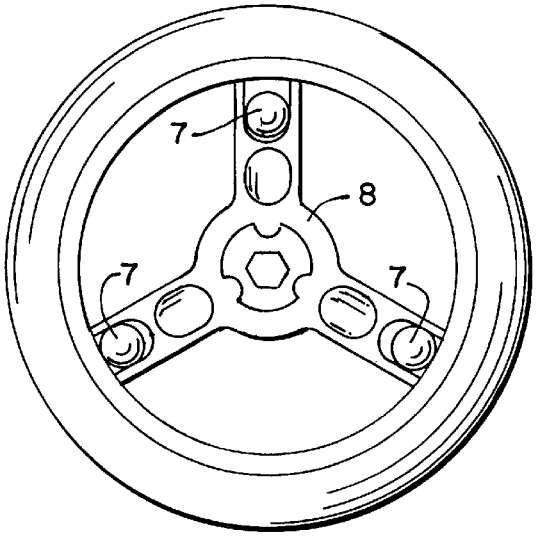
FIG. 3 is an elevation of the lateral face of the yo-yo showing an embodiment of the dynamic centrifugally/centripetally activated means.

The embodiment depicted in elevation in FIG. 3 utilizes three steel balls arranged in a three-spoked array in each yo-yo half, as the mass 7. When the mass 7 is centrifugally influenced it travels along a cam surface 10, shown in detail in FIG. 4, the cam surface 10 being the translation means of the embodiment shown, thereby laterally displacing the displaceable means 8 and pulling back the seizing/centering means 4 by means of push/pull rods 14 from contact with the yo-yo string and/or the lateral face(s) of the string bearing member 3. In an alternative embodiment, the push/pull rods 14 may release the seizing/centering means upon contact with the adjacent inner face of the recess 15 or the medial face of the yo-yo half. The seizing/centering means 4, should it contact the string, is thus free to spin, thereby providing reduced interference to the free spinning yo-yo. The cam surface 10 maintains the centrifugally activated mass 7 in an unstable position until the decaying centrifugal force can no longer resist the effective centripetal counter force provided counter force means 9 (In other words, until the rotational velocity of the clutch means falls below a predetermined value), which in this embodiment is preferably a spring or elastic compressible means. The displaceable means 8 is activated and the push/pull rods 14 carry the seizing/centering means 4 towards the yo-yo string and/or the lateral face(s) of the string bearing means 3 until seizure is achieved and the yo-yo automatically returns at a predetermined speed. This embodiment is understood as but one engineering method to utilize the centrifugal/centripetal forces or counter-centrifugal acting means either directly or indirectly. The invention could utilize lever, pivot, elbow, spring, push or pull means, elastic, electric or electronic, pneumatic, magnetic and/or hydraulically activated means or any combination thereof with one or multiple components effecting the same function of seizing/freeing/lateral supporting/centering and/or tripping of the yo-yo string and/or string bearing means 3. By way of example, an alternative embodiment could include a centrifugally activated switch completing a circuit and activating a solenoid.

Optionally the seizing/centering means 4 can be bypassed or not included when direct tripping of the yo-yo string is a preferred embodiment. This is achieved by extending push/pull rods 14 through the medial face of one or both yo-yo halves to intercept the path of the yo-yo string directly and when centrifugally activated clear the path of the yo-yo string, in which case bores 12 would traverse the first casing part 1.

Optionally the effective centripetal counter force 9 could be incorporated within the design of displaceable means 8 by utilizing a material and/or shape that develops rebound effective centripetal capacity when compressed by the centrifugal force generated by the spinning yo-yo. The displaceable means 8, shown in the drawings as a three-spoked embodiment, is provided with means to afford the mass 7 an operatively secure location, allow movement from a static/stable position to a dynamic/unstable position, and promote ease of assembly by an optional clip-into-position design. The design can allow the inclusion of decorative means securely held between the displaceable means 8, the lateral face of the first casing part 1, and the medial rim of the cap 16.

The present invention, by acting on the yo-yo string and/or the lateral face(s) of the string bearing means 3, allows a range of superior spinning bearings to be modularly used while still achieving the function of an automatically returning yo-yo. By centering and laterally supporting the yo-yo string a superior balanced yo-yo is provided which exhibits excellent loop-the-loop characteristics and ease of operation, especially for beginners.

In a further embodiment of the present invention, not shown, the seizing/centering means 4 may be associated with only one yo-yo half and compressively force the string bearing means 3 laterally against the medial face of the other yo-yo half so as to prevent the yo-yo from spinning relative to the string bearing means.

In yet another embodiment of the present invention, again not shown, the annular seizing/centering means may have a flange able to project a suitable distance over the circumferential face of the string bearing means 3 so as to center the yo-yo string.

In still another embodiment of the present invention, not shown, the displaceable member 8, suitably adapted, may be allowed to act directly on the lateral face(s) of the string bearing means 3.

Suitable materials for the manufacture of the seizing/centering means of the present modifications include polyacetyl, nylon, and other materials and alloys with a high resistance to wear and to friction-generated heat, and which are able to be molded and/or machined.

A wide range of materials is suitable for the manufacture of the yo-yo body of the present invention, however the preferred embodiment utilizes injection molded plastic for the substantial parts.

It is understood that the above description is intended to be illustrative and that other embodiments may be apparent to those skilled in the art without departing from the spirit of the claimed invention.

What is claimed is:

1. An automatically returning yo-yo comprising:

a first rotatable yo-yo half;

a second rotatable yo-yo half;

an axle-assembly mechanically coupling said first and second yo-yo halves and defining an axis of rotation about which said yo-yo halves can rotate;

a string having one end connected to said axle-assembly between said yo-yo halves; and at least one centrifugally-activated clutch which rotates with at least one of said yo-yo halves, said clutch including:

at least one engagement-member disposed for substantially linear movement in a direction which is at least substantially parallel to said rotation axis, the linear position of said engagement-member being dependent on the rotational velocity of said clutch; and at least one biasing member for resiliently urging said engagement-member into engagement with a portion of at least one of said string and said axle-assembly when the rotational velocity of said clutch is below a predetermined value.

2. The yo-yo of claim 1 wherein said axle-assembly includes at least one braking surface, and said engagement-member is linearly urged into engagement with said braking surface of said axle-assembly when the rotational velocity of said clutch is below said predetermined value.

3. The yo-yo of claim 1 wherein said yo-yo halves have medial faces with respective mid-points, said mid-points lying on said rotation axis; and said engagement-member is disposed for substantially linear movement along, and acts symmetrically about, said rotation axis.

4. The yo-yo of claim 1 wherein said clutch further comprises at least one of a cam, a cam surface, a lever, an elbow and a pivot means.

5. The yo-yo of claim 1 wherein said engagement-member includes at least one centrifugally influenced mass and translation means for converting centrifugally directed forces into axially directed forces, said translation means being operatively associated with said mass.

6. The yo-yo of claim 5 wherein said engagement-member includes a plurality of centrifugally influenced masses and said translation means are operatively associated with said masses.

7. The yo-yo of claim 1 wherein said axle-assembly comprises a string bearing member and an axle which is stationary relative to at least one of said yo-yo halves, said string bearing member having at least one braking surface, being mounted on said axle and being freely rotatable relative thereto;

said one string end is connected to said string bearing member; and said engagement-member is urged into engagement with at least one of said string and said braking surface when the rotational velocity of said clutch is below said predetermined value.

8. The yo-yo of claim 7 wherein said engagement-member includes at least one flanged annulus such that said engagement-member is urged into engagement with said string when the rotational velocity of said clutch is below said predetermined value.

9. The yo-yo of claim 7 wherein said yo-yo halves have medial faces, and said string bearing member is rotatably mounted on said axle at or near a midpoint between said medial faces of said yo-yo halves.

10. The yo-yo of claim 7 wherein said engagement-member is capable of engaging said string bearing member without interfering with said string.

11. The yo-yo of claim 7 wherein said clutch is arranged in a three-spoke array.

12. The yo-yo of claim 1 wherein said engagement-member is urged into engagement with both of said string and said axle-assembly when the rotational velocity of said clutch is below said predetermined value.

13. The yo-yo of claim 1 wherein said engagement-member is only urged into engagement with said string when the rotational velocity of said clutch is below said predetermined value.

14. The yo-yo of claim 13 wherein said engagement-member includes at least one flanged annulus removably mounted on said axle-assembly.

15. The yo-yo of claim 14 wherein said axle-assembly comprises a string bearing member and an axle; and said engagement-member is capable of engaging said string without interfering with said string bearing member.

16. A yo-yo comprising a first rotatable yo-yo half;

a second rotatable yo-yo half;

means for mechanically-coupling said first and second yo-yo halves and for defining an axis of rotation about which said yo-yo halves can rotate;

a string having ends, one of said string ends being connected to said means for mechanically-coupling at a point thereof which is between said yo-yo halves; and centrifugally-activated clutch means for translating centrifugal forces of at least one of said yo-yo halves in a first plane into linearly-directed forces in a second plane which intersects said first plane; said clutch means includes at least one engagement-member disposed for substantially linear movement within said second plane.

17. The yo-yo of claim 16 wherein:

said means for coupling includes means for bearing said string, said means for bearing having at least one lateral face;

said string is connected to said means for bearing; and said clutch means includes at least one engagement-member disposed for substantially linear movement in a direction which is at least substantially parallel to said rotation axis, the linear position of said engagement-member being dependent on the rotational velocity of said clutch means, said clutch means also including at least one biasing member for resiliently urging said engagement-member into engagement with at least one of said string ends and said means for bearing when the rotational velocity of said clutch means is below a predetermined value.

18. The yo-yo of claim 17 wherein said engagement-member is urged into engagement with both of said string ends and said means for bearing when the rotational velocity of said clutch means is below said predetermined value.

19. The yo-yo of claim 16 wherein:

said clutch means includes at least one means for engaging disposed for substantially linear movement in a direction which is at least substantially parallel to said rotation axis;

the position of said engagement member is dependent on the rotational velocity of said clutch means; and said clutch means also includes means for urging said means for engaging into engagement with at least one of said string and said means for coupling when the rotational velocity of said clutch is below a predetermined value.

20. An automatically returning yo-yo comprising:

a first rotatable yo-yo half;

a second rotatable yo-yo half;

an axle-assembly mechanically coupling said first and second yo-yo halves and defining an axis of rotation about which said yo-yo halves can rotate, said axle-assembly comprising a string bearing member and an axle which is stationary relative to at least one of said yo-yo halves, said string bearing member having at least one braking surface, being mounted on said axle and being freely rotatable thereto;

a string having one end connected to said string bearing member between said yo-yo halves; and at least one centrifugally-activated clutch which rotates with at least one of said yo-yo halves, said clutch including:

at least one engagement member disposed for substantially linear movement in a direction which is at least substantially parallel to said rotation axis, the linear position of said engagement-member being dependent on the rotational velocity of said clutch; and at least one biasing member for resiliently urging said engagement member into engagement with at least one of said string and said braking surface when the rotational velocity of said clutch is below a predetermined value.

21. The yo-yo of claim 20 wherein said engagement-member includes at least one flanged annulus mounted on said axle-assembly.

22. The yo-yo of claim 21 wherein said engagement-member is urged into engagement with both of said string and said braking surface.

23. The yo-yo of claim 21 wherein said engagement-member is capable of engaging said string bearing member without interfering with the string.

24. The yo-yo of claim 21 wherein said engagement-member is capable of engaging said string without interfering with said string bearing member.

25. The yo-yo of claim 20 wherein said engagement-member is substantially coaxially adjacent said string bearing member.

26. The yo-yo of claim 20 wherein said yo-yo halves have medial faces with respective mid-points, said mid-points lying on said rotation axis; and said engagement-member is disposed for substantially linear movement along, and acts symmetrically about, said rotation axis.

27. The yo-yo of claim 20 wherein said engagement-member includes at least one centrifugally influenced mass and translation means for converting centrifugally directed forces into axially directed forces, said translation means being operatively associated with said mass.

28. The yo-yo of claim 27 wherein said clutch further comprises at least one of a cam, a cam surface, a lever, an elbow and a pivot means.

29. The yo-yo of claim 27 wherein said engagement-member includes a plurality of centrifugally influenced masses and said translation means are operatively associated with said masses.

30. The yo-yo of claim 29 wherein said clutch is arranged in a three-spoke array.

31. The yo-yo of claim 20 wherein said string bearing member is interchangeable.

32. The yo-yo of claim 20 wherein at least a portion of said clutch can be removed to thereby convert said automatically returning yo-yo into a non-automatically returning yo-yo.

33. An automatically returning yo-yo comprising:

a first rotatable yo-yo half;

a second rotatable yo-yo half;

an axle-assembly mechanically coupling said first and second yo-yo halves and defining an axis of rotation about which said yo-yo halves can rotate, said axle-assembly having an axle and a string bearing member mounted on and freely rotatable relative to said axle;

a string having one end connected to said string bearing member; and at least one centrifugally-activated clutch which rotates with at least one of said yo-yo halves, said clutch including:

at least one engagement-member disposed for substantially linear movement in a direction which is at least substantially parallel to said rotation axis, the linear position of said engagement-member being dependent on the rotational velocity of said clutch; and at least one biasing member for resiliently urging said engagement-member into engagement with said string when the rotational velocity of said clutch is below a predetermined value.

34. The yo-yo of claim 33 wherein said string bearing member has a braking surface and said engagement-member includes at least one flanged annulus mounted on said axle-assembly.

35. The yo-yo of claim 34 wherein said engagement-member is urged into engagement with both of said string and said braking surface.

36. The yo-yo of claim 34 wherein said engagement-member is capable of engaging said string bearing member without interfering with the string.

37. The yo-yo of claim 34 wherein said engagement-member is capable of engaging said string without interfering with said string bearing member.

38. The yo-yo of claim 33 wherein said engagement-member is substantially coaxially adjacent said string bearing member.

39. The yo-yo of claim 33 wherein said yo-yo halves have medial faces with respective mid-points, said mid-points lying on said rotation axis; and said engagement-member is disposed for substantially linear movement along, and acts symmetrically about, said rotation axis.

40. The yo-yo of claim 33 wherein said engagement-member includes at least one centrifugally influenced mass and translation means for converting centrifugally directed forces into axially directed forces, said translation means being operatively associated with said mass.

41. The yo-yo of claim 40 wherein said clutch further comprises at least one of a cam, a cam surface, a lever, an elbow and a pivot means.

42. The yo-yo of claim 40 wherein said engagement-member includes a plurality of centrifugally influenced masses and said translation means are operatively associated with said masses.

43. The yo-yo of claim 42 wherein said clutch is arranged in a three-spoke array.

44. The yo-yo of claim 33 wherein said string bearing member is interchangeable.

45. The yo-yo of claim 33 wherein the string bearing member can be removed to thereby convert said automatically returning yo-yo into a non-automatically returning yo-yo.

46. An automatically returning yo-yo comprising:

a first rotatable yo-yo half;

a second rotatable yo-yo half;

an axle-assembly mechanically coupling said first and second yo-yo halves and defining an axis of rotation about which said yo-yo halves can rotate, said axle-assembly having an axle;

a string having one end connected to said axle-assembly with a single-loop string attachment; and at least one centrifugally-activated clutch which rotates with at least one of said yo-yo halves, said clutch including:

at least one movable engagement-member wherein the position of said engagement-member is dependent on the rotational velocity of said clutch; and at least one biasing member for resiliently urging said engagement-member into engagement with said string when the rotational velocity of said clutch is below a predetermined value; said engagement-member is disposed for substantially linear movement along, and acts symmetrically about, said rotation axis.

47. The yo-yo of claim 46 wherein said axle-assembly further comprises a string bearing member which has a braking surface and wherein said engagement-member includes at least one flanged annulus mounted on said axle-assembly.

48. The yo-yo of claim 46 wherein said yo-yo halves have medial faces with respective mid-points, said mid-points lying on said rotation axis.

49. The yo-yo of claim 46 wherein said engagement-member includes at least one centrifugally influenced mass and translation means for converting centrifugally directed forces into axially directed forces, said translation means being operatively associated with said mass.

* * * * *